United States Patent [19]

Arkhipov et al.

[11] Patent Number: 4,863,349

[45] Date of Patent: Sep. 5, 1989

[54] IMPELLER OF CENTRIFUGAL COMPRESSOR

[75] Inventors: Vladimir V. Arkhipov; Gennady F. Velikanov; Gilya A. Raer; Kir B. Sarantsev, all of Leningrad, U.S.S.R.

[73] Assignee: Proizvodstvennoe Obiedinenie "Nevsky Zavod" Imeni V.I. Lenina, Leningrad, U.S.S.R.

[21] Appl. No.: 241,989

[22] PCT Filed: Nov. 28, 1986

[86] PCT No.: PCT/SU86/00124

§ 371 Date: Jul. 13, 1988

§ 102(e) Date: Jul. 13, 1988

[87] PCT Pub. No.: WO88/03994

PCT Pub. Date: Jun. 2, 1988

[51] Int. Cl.[4] ..... F04D 29/28; F04D 17/18

[52] U.S. Cl. ..... 416/186 R; 416/223 B

[58] Field of Search ..... 416/183, 185, 188, 186 R, 416/186 A, 223 B

[56] References Cited

U.S. PATENT DOCUMENTS

| | | | |
|---|---|---|---|
| 892,262 | 6/1908 | Jaeger | 416/186 R X |
| 1,600,708 | 9/1926 | Baumann | 416/186 R |
| 1,953,064 | 4/1934 | Dowson | 416/186 R |
| 2,392,858 | 1/1946 | McMahan | 416/186 R |
| 2,441,432 | 5/1948 | McGee | 416/188 |
| 2,799,445 | 7/1957 | Hull | 416/188 |
| 3,884,595 | 5/1975 | Herrick | 416/186 R X |

FOREIGN PATENT DOCUMENTS

| | | | |
|---|---|---|---|
| 509458 | 10/1930 | Fed. Rep. of Germany | 416/223 B |
| 5458 | 1/1980 | Japan | 416/183 |
| 132499 | 10/1981 | Japan | 416/223 B |
| 81778 | 5/1953 | Norway | 416/188 |
| 335505 | 9/1930 | United Kingdom | 416/183 |

*Primary Examiner*—Everette A. Powell, Jr.

*Attorney, Agent, or Firm*—Burgess, Ryan & Wayne

[57] ABSTRACT

The invention relates to compressor manufacture. The impeller comprises a base disc (1) wherein, according to the invention, the angle ($\beta$) between its internal surface (5) and the plane (p) perpendicular to the impeller rotation axis (0—0) is 0.5–1° larger than the angle ($\alpha$) between its external surface (4) and the same plane (p).

1 Claim, 2 Drawing Sheets

IMPELLER OF CENTRIFUGAL COMPRESSOR

FIELD OF THE INVENTION

The present invention relates to compressor manufacture and, more particularly, to the impeller of a centrifugal compressor.

PRIOR ART

Known in the prior art is the impeller of a centrifugal compressor comprising a base disc with cylindrical vanes and a cover disc. The web of the base disc has internal and external surfaces whose generatrices are set at different angles to the plane perpendicular to the axis of impeller rotation (see, for example, V.F. Ris. Centrifugal Compression Machines, Moscow/Leningrad, Machinostroenie, 1964, pp. 10, 265).

The base impeller disc is made up of a solid hub and a relatively thin web, the generatrix of the internal web surface being perpendicular to the impeller rotation axis whereas the generatrix of the external surface of the base disc web is set at an angle to the rotation axis.

The base disc is acted upon by the bending moment of the centrifugal forces of the mass of vanes arranged asymmetrically to the disc and by the bending moment of assymmetrically distributed masses of the web, both moments being unidirectional and summarized.

The maximum stresses develop in the section of the disc which is close to the point of disc-to-vane attachment. The same section, apart from having concentrators of stresses arising due to the nature of disc-to-vane attachment, is characterized by heaviest wear and corrosion caused by the flow of gas. All these factors call for high safety margins and the use of materials characterized by high mechanical properties. Therefore, the base discs in the known impeller are made of high-strength steel forgings.

However, the use of such forgings for making the base discs requires a large amount of labour and extensive consumption of metal for blanks. Utilization of rolled stock for making the base discs would cut down considerably the labour and metal content, but the rolled stock has lower mechanical properties and cannot be used in the impellers running at high peripheral speeds, $V > 180$ m/s.

DISCLOSURE OF THE INVENTION

The main object of the present invention is to provide the impeller of a centrifugal compressor wherein, due to a special design of the surfaces of the base disc the latter would feature a low level of stresses at the point of disc-to-vane attachment which would enable the disc to be made of rolled stock.

This problem is solved by providing the impeller of a centrifugal compressor comprising a base disc carrying cylindrical vanes and a cover disc, the web of the base disc having internal and external surfaces whose generatrices are set at different angles to the plane perpendicular to the impeller rotation axis wherein, according to the invention, the angle between the internal surface of the base disc web and the plane perpendicular to the impeller rotation axis is 0.5°–1° larger than the angle between the external surface and the same plane.

The web of the base disc in such an impeller is acted upon by the centrifugal force created by the mass of the disc proper and by the centrifugal force of a part of the mass of vanes. At a selected difference of inclination angles of the generatrices of the internal and external web surfaces its middle section line is set at such an angle to the impeller rotation axis that the effect of the bending moments generated by the centrifugal forces of the mass of web and of a part of the mass of vanes is directed in the opposite way. The total bending moment acting on the web is defined by the difference of these moments, and, consequently, stresses in the dangerous section of said web. The difference of inclination angles (0.5°–1°) of the generatrices of the external and internal surfaces of the web is selected with a view to ensure minimum stresses in the dangerous section. Thus, the reduced level of stresses in the base disc web enables said base disc to be made from rolled stock.

SUMMARY OF THE DRAWINGS

Now, the invention will be described in detail by way of example with reference to the appended drawings, in which.

BEST MODE OF CARRYING OUT THE INVENTION

Figure 1:
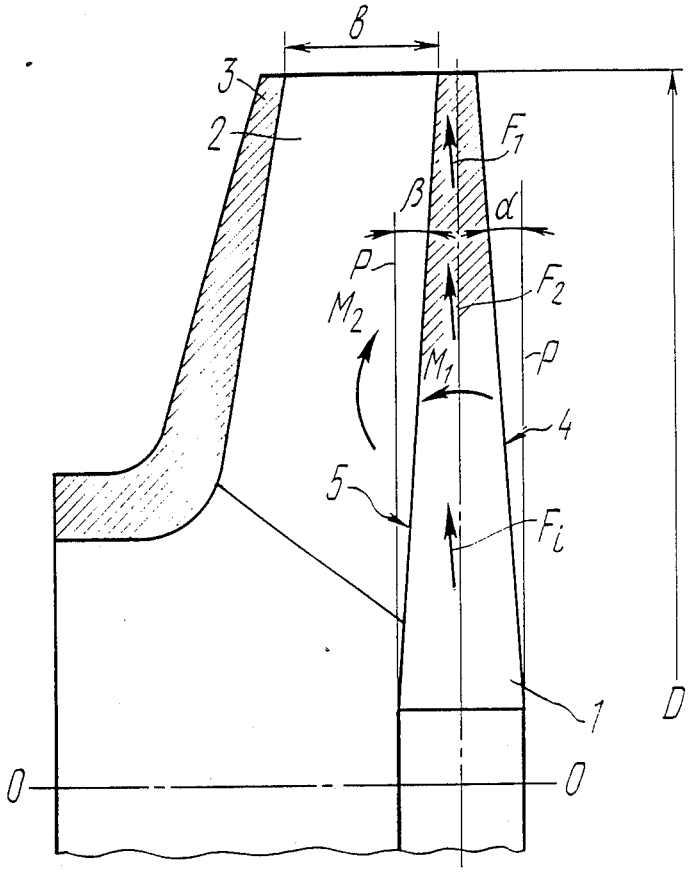
FIG. 1 is a longitudinal section of a part of the impeller, according to the invention.

The herein-proposed impeller of a centrifugal compressor comprises a base disc 1 (FIG. 1) carrying rigidly attached (welded or soldered) vanes 2 and a cover disc 3. The web of the base disc 1 has external and internal surfaces 4 and 5, respectively, whose generatrices are inclined to the plane p perpendicular to the impeller rotation axis 0—0 at angles $\alpha$ and $\beta$ where $\alpha$ is the angle between the generatrix of the external surface 4 and the plane p perpendicular to the impeller rotation axis 0—0, and $\beta$—angle between the generatrix of the internal surface 5 and the same plane p. The angle $\beta$ is 0.5°–1° larger than the angle $\alpha$.

Shown arbitrarily in FIG. 1 are the outside diameter D of the impeller and the width b of the flow passage at the impeller outlet.

In the rotating impeller the bending moment $M_1$ caused by centrifugal forces $F_1, F_2, \ldots F_i$ of the mass of the web of the disc 1 is directed to the internal surface 5 while the bending moment $M_2$ caused by centrifugal forces (not shown in the Figure) of the mass of vanes 2 is directed to the external surface 4, the summary bending moment being equal to the difference of moments $M_1$ and $M_2$.

Figure 2:
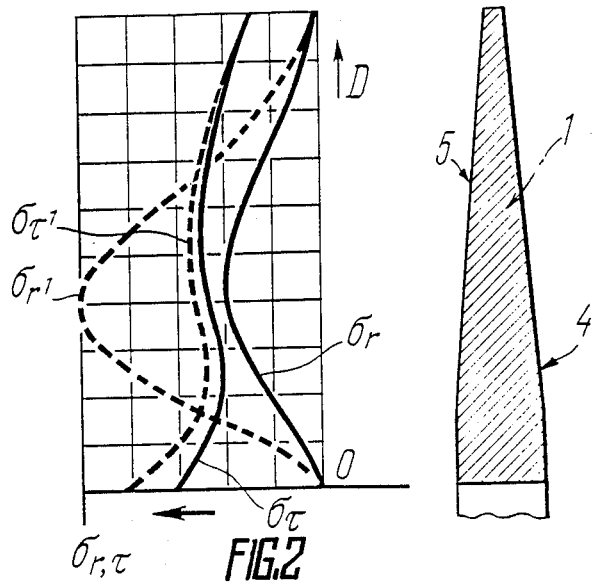
FIG. 2 shows the curves of radial and tangential stresses on the internal surface of the web of the impeller base disc, according to the invention, and on the internal surface of the web of the base disc of the previously known impeller.

FIG. 2 shows the curves of radial $\sigma_T$ and $\sigma_T'$ and tangential $\sigma_T$ and $\sigma_T$ (peripheral) stresses on the internal surface 5 of the web of the impeller base disc 1. Continuous lines show the stresses $\sigma_T$ and $\sigma_T$ in the impeller, according to the invention, and dotted lines show stresses $\sigma_T'$ and $\sigma_T'$ in the known impeller. The disc 1 of the proposed impeller is subjected to substantially lower stresses $\sigma_T$ and $\sigma_T$ (by 30–50%) than stresses $\sigma_T'$ and $\sigma_T'$ in the disc of the known impeller.

Figure 3:
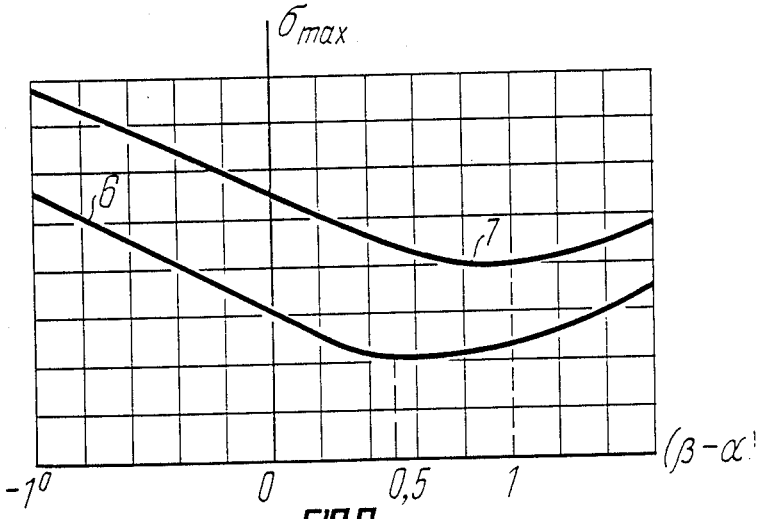
FIG. 3 illustrates the charts showing the relation between the stresses in the dangerous section of the disc and the difference of the angles of the disc surface generatrices to the plane perpendicular to the impeller rotation axis, according to the invention.

Shown in FIG. 3 are the experimentally gained relations between maximum stresses $\sigma_{Tmax}$ and $\sigma_{Tmax}$ on the internal surface 5 of the base disc 1 and the difference of angles ($\beta-\alpha$). This relation holds true for the two extreme values of the relation of flow passage width b at the impeller outlet to the impeller ourside diameter D. Curve 6 corresponds to b/D=0.03 and curve 7, to b/D=0.07. (Impellers with relations from 0.03>b/D>0.07 are used quite seldom due to their low efficiency). The difference ($\beta-\alpha$) of the angles at which the generatrices of the external surface 4 and the internal surface 5 of the web to the plane p perpendicular to the impeller rotation axis 0—0 is selected with a view to ensuring minimum stresses $\sigma_T$ and $\sigma_T$ in the dangerous section of the base disc 1, namely: for the impellers with b/D=0.05–0.07 this difference should range from 0.75° to 1° while for the impellers with b/D=0.04–0.05 this difference should range from 0.5° to 0.75°.

The engineering and economical efficiency of the proposed invention consists in reducing the stressing of the base disc which makes it possible to reduce the thickness of the hub and make the disc from rolled sock instead of forgings thereby reducing the metal consumption and the amount of labour required in disc manufacture.

INDUSTRIAL APPLICABILITY

Most successfully the present invention may be utilized in the impellers of high-pressure shrouded single-suction centrifugal compressors.

We claim:

1. Impeller of a centrifugal compressor comprising a base disc (1) carrying cylindrical vanes (2) and a cover disc (3) and having an external surface (4) and an internal surface (5) of its web, the generatrices of the surfaces being set at different angles to the plane (p) perpendicular to the impeller rotation axis (O-O) characterized in that the angle ($\beta$) between the internal surface (5) of the web of the impeller base disc (1) and the plane (p) perpendicular to the impeller rotation axis (O-O) is 0.5°–1° larger than the angle ($\alpha$) between the external surface (4) of the web of the base disc (1) and the same plane (p).

* * * * *